United States Patent [19]

Schauble

[11] Patent Number: 4,809,432

[45] Date of Patent: Mar. 7, 1989

[54] DISPOSABLE RAZOR AND EMOLLIENT DISPENSING DEVICE

[75] Inventor: George Schauble, Paterson, N.J.

[73] Assignee: Shaverd Corp., N.J.

[21] Appl. No.: 933,973

[22] Filed: Nov. 24, 1986

[51] Int. Cl.[4] ..... B26B 17/44

[52] U.S. Cl. ..... 30/41; 30/86; 222/494

[58] Field of Search ..... 30/41, 86, 32, 85; 222/494

[56] References Cited

U.S. PATENT DOCUMENTS 2,755,974 7/1956 Godfrey ..... 222/494
2,786,270 3/1932 Orlando et al. ..... 30/41
4,653,188 3/1987 Kwak ..... 30/41

*Primary Examiner*—Douglas D. Watts
*Attorney, Agent, or Firm*—Siegmar Silber

[57] ABSTRACT

The invention described herein is of a disposable razor with an emollient dispensing device. The combination includes two main assemblies, a handle structure, which includes a reservoir portion, and a razor head assembly, which includes an emollient distributing mechanism. A flow controller is also provided. In the best mode of practicing the invention, the flow control means is a pressure-operated, check valve which, in turn, includes a disk to block emollient flow and a resilient return element.

15 Claims, 4 Drawing Sheets

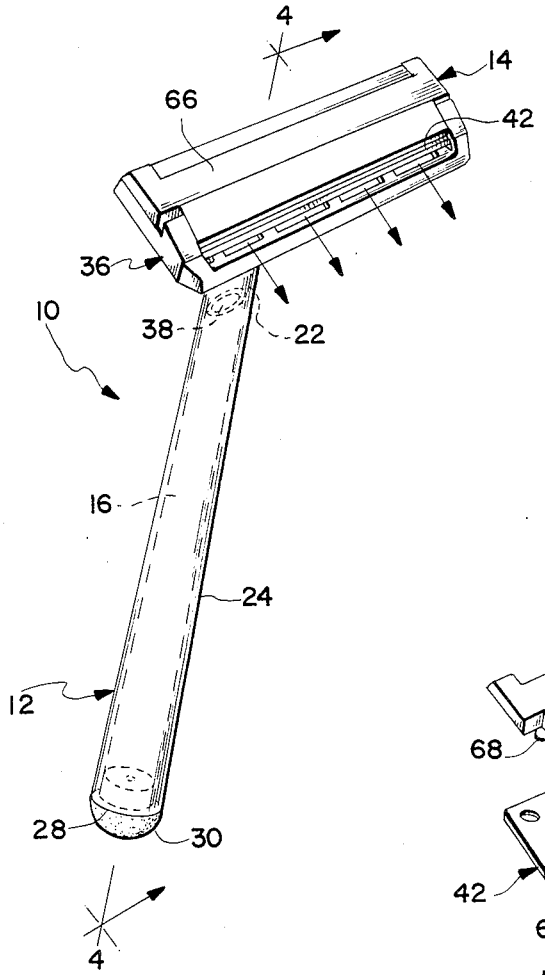
FIG. 1
FIG. 2
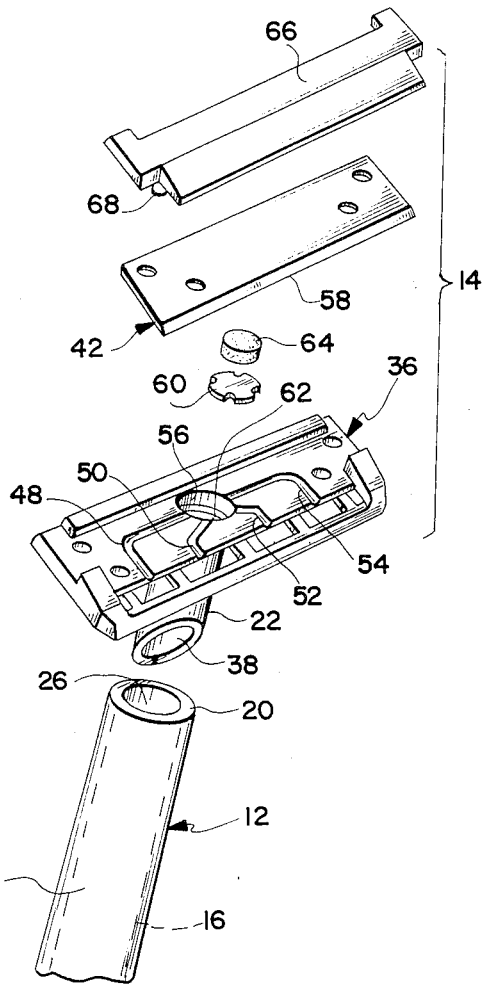

FIG. 3
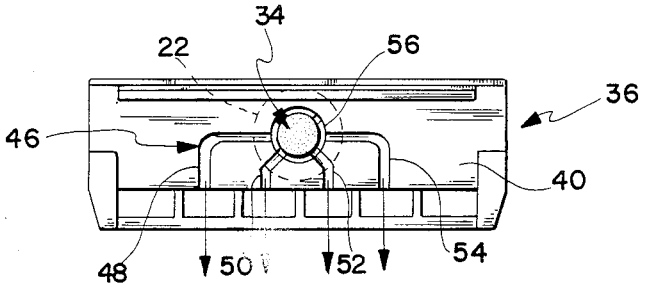
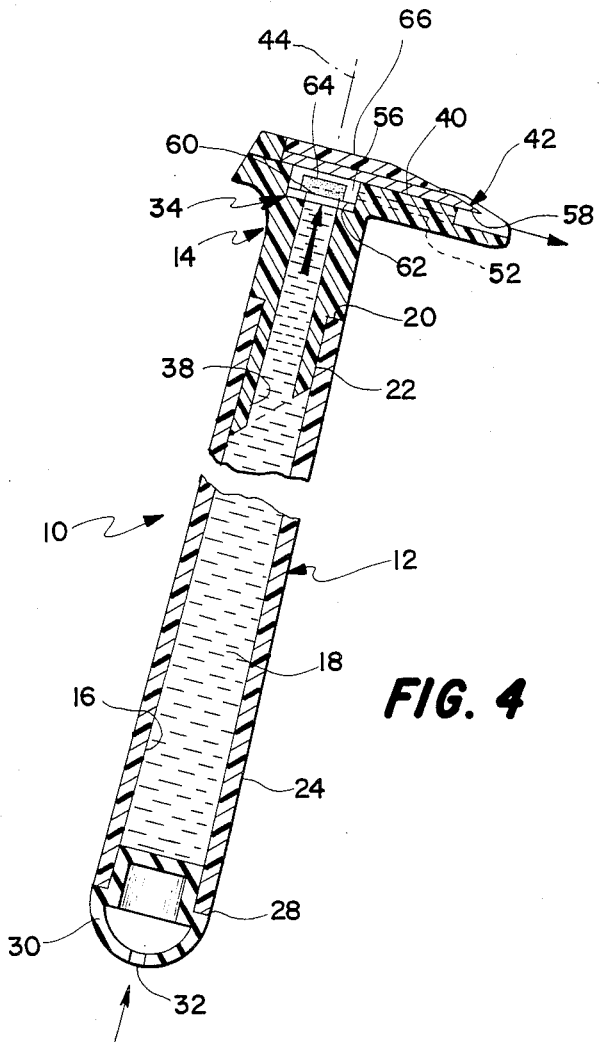
FIG. 4

DISPOSABLE RAZOR AND EMOLLIENT DISPENSING DEVICE

BACKGROUND OF THE INVENTION

1. Field of the Invention

This invention relates to a disposable razor with an emollient reservoir attached thereto for delivery of the emollient to the razor's edge, and more particularly with a valved interconnection between the reservoir and the emollient distributor.

2. Disclosure Information Statement

This disclosure information includes the results of a marketplace search, and further discloses patent markings on various products. The disposable razor market in the United States is dominated by a few, highly touted product groups distributed by corporations that are familiar household names, to wit, BIC, Gillette and Schick. The BIC® shavers are manufactured by BIC Corporation, Milford, Conn. and do not contain patent markings. On the other hand, the product Packaging of The Gillette Company, Safety Razor Division, Boston, Mass. and Schick unit of Warner-Lambert Co., Morris Plains, N.J. contains extensive markings as follows:

| I. Utility Patents | | |
|---|---|---|
| 3,703,764 | 3,829,969 | 4,111,602 |
| 3,724,070 | 4,026,016 | 4,205,437 |
| 3,768,162 | 4,047,296 | 4,266,664 |
| 3,786,503 | 4,094,063 | 4,328,615 |
| 3,786,563 | 4,094,065 | 4,344,277 |

| II Design Patents | |
|---|---|
| D224,479 | D262,239 |
| D244,852 | D266,960 |
| D242,661 | 269,915 |
| D243,638 | D274,010 |
| D257,327 | |

While none of these patents are descriptive of a disposable razor with a valved emollient reservoir, the information and teachings thereof are illustrative of the disposable razor art. items have come tot he attention of the inventor, namely: (1) U.K. Patent Application, GB No. 2141656A, bearing an application publication date of Jan. 3, 1985; (2) U.S. Pat. No. 3,715,942 to Donald L. Courtney, dated Feb. 13, 1973; and (3) an item entitled "Strip Tease" in *Drug Topics,* Oct. 6, 1986 edition (p.91) introducing a disposable razor featuring a "Lubra-smooth strip." These items are of further interest as background to the present invention.

SUMMARY

The invention described herein is of a disposable razor with an emollient dispensing device. The combination includes two main assemblies, a handle structure, which includes a reservoir portion, and a razor head assembly, which includes an emollient distributing mechanism. A flow controller is also provided. In the best mode of practicing the invention, the flow control means is a pressure-operated, check valve which, in turn, includes a disk to block emollient flow and a resilient return element. Other embodiments describe a flow control means consisting of a plug arrangement carried by the protective cover of the razor and also a version for pivoting head razors in which the flow control means is built into the hinge arrangement.

OBJECTS OF THE INVENTION

It is an object of the present invention to provide a disposable razor which is simple to use and economical of manufacture.

It is a further object of the present invention to provide a disposable razor with an emollient reservoir from which the emollient is controllably releasable.

It is a yet further object of the present invention to provide a disposable razor having a valved emollient reservoir, the valve thereof operating to seal against and to permit the outflow of emollient from the reservoir.

It is a still yet a further object of the present invention to provide a disposable razor for shaving of face, legs or underarms wherein the user controls the distribution of a lubricating emollient to the razor's edge and only requires water to dampen the body surface to be shaved.

It is a feature of the present invention that the razor handle incorporates an emollient reservoir.

It is a further feature of the present invention that a valve controls the flow of emollient from the reservoir to the razor's edge.

It is a yet further feature of the present invention that the valve thereof is operated by applying pressure to a flexible closure device at the end of the handle opposite the razor.

Other objects and features of the invention will become apparent during the course of the detailed description which follows.

BRIEF DESCRIPTION OF THE DRAWINGS

FIG. 1 is a perspective view of a disposable razor with valved emollient reservoir in accordance with the first embodiment of the invention;

FIG. 2 is an exploded sectional view of the embodiment of FIG. 1 showing the valve elements and the reservoir-to-razor;

FIG. 3 is a detailed top plan view of the razor head;

FIG. 4 is a detailed sectional view of the assembled valve of FIG. 2;

DESCRIPTION OF THE PREFERRED EMBODIMENT

Figure 5:
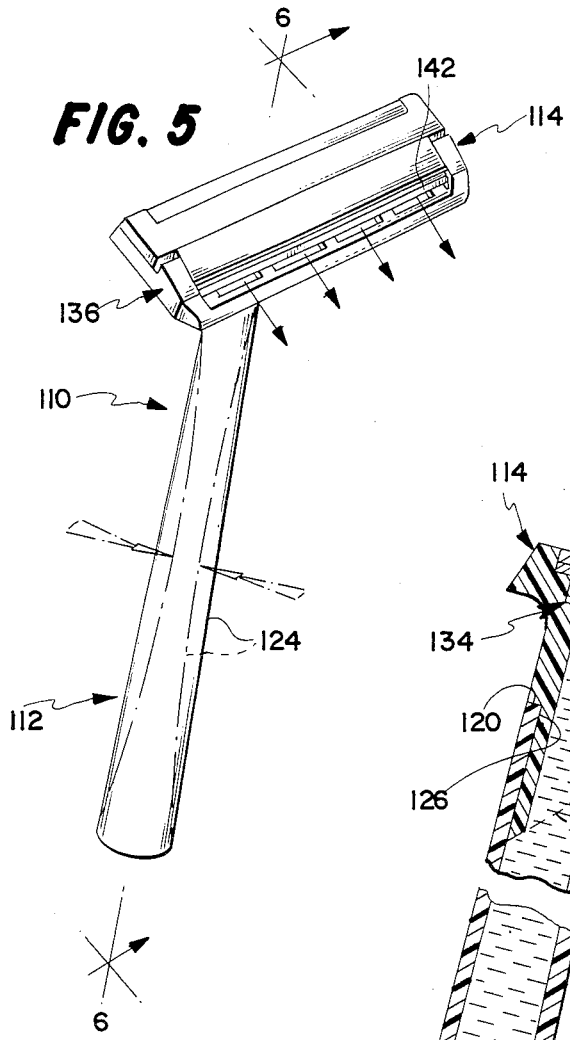
FIG. 5 is a perspective view of a disposable razor and emollient dispensing device in accordance with the second embodiment of the invention.

The disposable razor and emollient dispensing device of this invention is shown in a perspective view in FIG. 1, in which the device is referred to generally by the numeral 10. The disposable razor and emollient dispensing device 10 is constructed to include two major subassemblies, namely, the elongate body or handle assembly 12 and the razor head assembly 14. In the best mode of practicing this invention, an emollient reservoir 16 is housed within the handle assembly 14, which reservoir is for supplying emollient 18 in a controlled manner to the razor's edge. The inner end 20 of the handle assembly 12 is constructed to join, connect or attach to the central portion 22 of the head assembly 14. When so attached, the outer portion 24 of the elongate body 12 forms a handle for the disposable razor and emollient dispensing device 10. The emollient reservoir 16 is constructed to include at or adjacent the inner end 20 an outflow orifice or passageway 26 for passing emollient from the handle assembly 12 to the razor head assembly 14 and further to include at the outer end 28 a plastic or rubber bulb 30 with a vent hole 32 therein for inducing pressure build up within the reservoir and urging the emollient toward the outflow orifice 26. The structure of the pressure inducing mechanism, while shown in the form of a plastic or rubber bulb in the best mode of the invention, may be adapted by one skilled in the art and in accordance with the flow characteristics of the emollient. In some applications, a handle structure having a flexible wall would provide the necessary pressure inducing mechanism.

Referring now to FIGS. 2, 3, and 4 further details of the disposable razor and emollient dispensing device 10 are shown. Of particular note is the structure of the razor head assembly 14 and the flow control device or valve 34. The valve 34 is exemplary only of flow control devices and, while it is illustrated as a disk-type, normally closed, check valve, it may be any of a member of devices including a bleed valve, a sleeve valve, or given appropriate flow characteristics, an ordinary plug arrangement. While in the several embodiments hereof a variety of flow control structures is seen, variations could be provided without departing from the spirit of this invention. In the best mode of practicing the present invention, the razor head assembly 14 is constructed with a razor mounting block 36 having an emollient infeed 38 which functions cooperatively with the outflow orifice 26 and a blade mounting face 40 for attaching a razor blade 42 thereto. Although only one razor blade 42 is shown, it is known within the disposable razor art to structure a razor mounting block 36 so as to accommodate one or more razor blades 42. (See U.S. Pat. No. 3,724,070 to F. W. Dorion, Jr., supra. The razor mounting block mounts to the elongate body 12 so that the longitudinal axis 44 of the body 12 lies in a plane normal to the plane in which face 40 lies. On the blade side of block 36, an emollient distributor device 46 is provided. The emollient distributor device 46, in turn, consists of channels 48, 50, 52 and 54 each of which stream from a well or collection area 56 to edge 58 of razor blade 42. The flow control device 34 is constructed to be housed at the outflow of emollient infeed 38 and includes a valve 60 for operation against valve seat 62. While check valve 34 is shown located in the fluid stream adjacent the emollient distributor, the control could be located at other locations along the stream. For valve return purposes, a compressible foam insert 64 is used. Thus, the valve is constructed so that, in the absence of pressure induced in the emollient, the compressible element (whether a spring or foam insert) urges the disk against the valve seat. Other details in FIG. 3 show the razor attaching block 66 with attaching pegs or projections 68 for holding the head assembly together.

Figure 6:
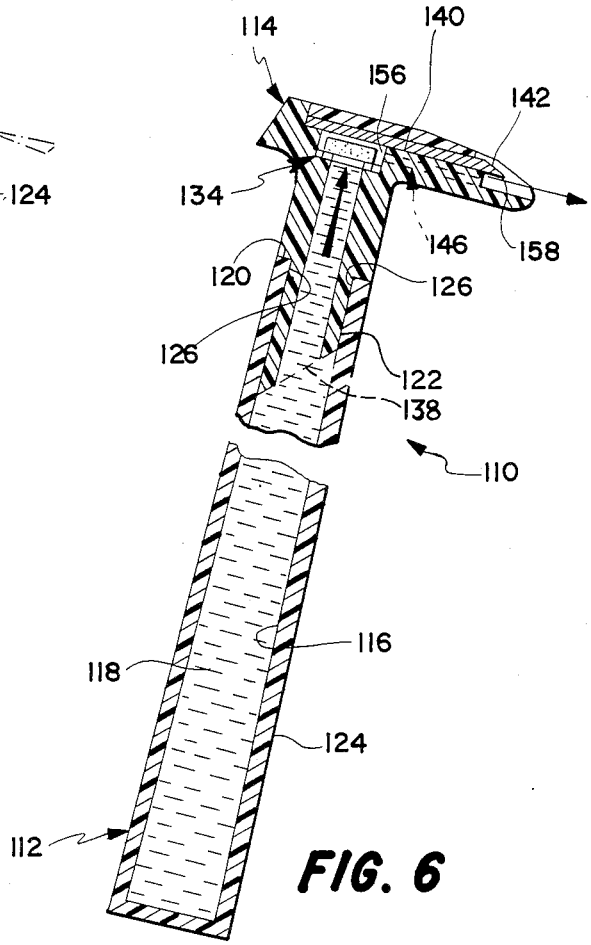
FIG. 6 is a detailed sectional view of FIG. 5.

In the description of the second embodiment which follows reference is made to FIGS. 5 and 6. In these drawings reference designators in the "100" series are used and second embodiment parts corresponding to those in the first embodiment are given designators "100" units higher than previously. Thus, an outflow orifice 126 of the second embodiment corresponds to outflow 26 of the first embodiment. Similarly, the description of the third embodiment parts are provided with reference designators in the "200" series.

The disposable razor and emollient dispensing device of the second embodiment of this invention is shown in FIGS. 5 and 6, in which the device is referred to generally by the numeral 110. The disposable razor and emollient dispensing device 110 is constructed to include two major subassemblies, namely, the elongate body or handle assembly 112 and the razor head assembly 114. An emollient reservoir 116 is housed within the handle assembly 114, which reservoir is for supplying emollient 118 in a controlled manner to the razor's edge. The inner end 120 of the handle assembly 112 is constructed to be joined to the central portion 122 of the head assembly 114. When so joined, the outer portion 124 of the elongate body 112 forms a handle for the disposable razor and emollient dispensing device 110. The emollient reservoir 116 is constructed to include at or adjacent the inner end 120 an outflow orifice or passageway 126 for passing emollient from the handle assembly 112 to the razor head assembly 114. The second embodiment is structured to include a resiliently walled handle.

Further, a plug-type flow control device 124 is included. The razor head assembly 114 is constructed with a razor mounting block 136 having an emollient infeed 138 which functions cooperatively with the outflow orifice 126 and a blade mounting face 140 for attaching a razor blade 142 thereto. On the blade side of block 136, an emollient distributor device 146 is provided. The emollient distributor device 146, in turn, consists of channels 148, 150, 152 and 154 each of which stream from a well 156 to edge 158 of razor blade 142. The flow control device or plug 134 is constructed to be carried by the razor protective cover 159 and emplaced into the emollient outflow point to control fluid flow.

Figure 7:
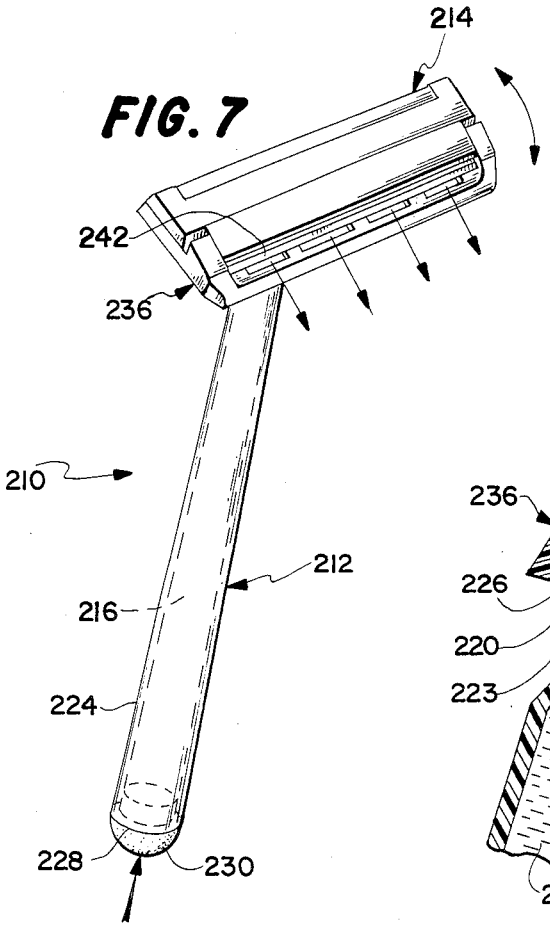
FIG. 7 is a perspective view of a third embodiment of the invention.
Figure 8:
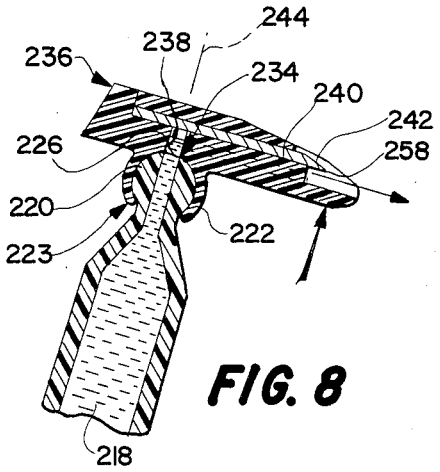
FIG. 8 is a detailed sectional view of FIG. 7 showing the valve in an open condition; and, FIG. 9 is a detailed sectional view of FIG. 7 showing the valve in closed position with the protective cover in place.
Figure 9:
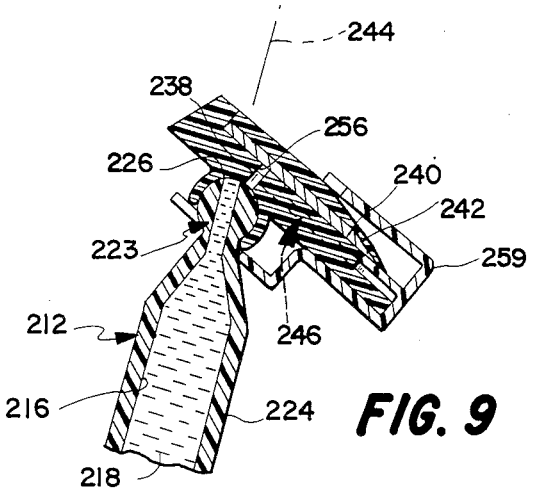

The disposable razor and emollient dispensing device of the third embodiment of this invention is shown in FIGS. 7 and 8, in which the device is referred to generally by the numeral 210. The disposable razor and emollient dispensing device 210 is constructed to include two major subassemblies, namely, the elongate body or handle assembly 212 and the razor head assembly 214. As in the previously described embodiments, an emollient reservoir 216 is housed within the handle assembly 214, which reservoir is for supplying emollient 218 in a controlled manner to the razor's edge. The inner end 220 of the handle assembly 212 is constructed to be pivotably attached to the central portion 222 of the head assembly 214 by hinge 223. When so attached, the outer portion 224 of the elongate body 212 forms a handle for the disposable razor and emollient dispensing device 210. The emollient reservoir 216 is constructed to include at or adjacent the inner end 220 an outflow orifice or passageway 226 for passing emollient from the handle assembly 212 to the razor head assembly 214. Further, the device includes at the outer end 228 a plastic or rubber bulb 230 with a vent hole 232 therein for inducing pressure build up within the reservoir and urging the emollient toward the outflow orifice 226. In this embodiment, of particular note is the structure of a cylindrical or sleeve-type valve 234 which is included within hinge 235. The razor head assembly 214 is constructed with a razor mounting block 236 having an emollient infeed passageway 238 which functions cooperatively with the outflow orifice 226 and with a blade mounting face 240 for attaching a razor blade 242 thereto. The emollient outflow passageway 226 and the emollient infeed passageway 238 are constructed in the corresponding portions of hinge 223 so that, as handle assembly 212 pivots through a predetermined angular range in relation to razor head assembly 214, the pivoting action places the two passageways into and out of communication with one another and thereby opens and closes the valve. The razor mounting block mounts to the elongate body 212 so that the longitudinal axis 244 of the body 212 lies in a plane normal to the plane in which face 240 lies throughout the previously described angular range. On the blade side of block 236, an emollient distributor device 246 is provided. The emollient distributor device 246, in turn, consists of channels 248, 250, 252 and 254 each of which stream from a well 256 to edge 258 of razor blade 242.

As in the second embodiment, the device 210 may optionally be constructed to include a razor protective cover 259 which, however in this case, has the additional function of fixing the pivoting handle location in its range so the cylindrical valve is in the closed position when the cover is in place.

Although the best mode of the invention has been described herein in some detail, it has not been possible to include each and every variation. Those skilled in the art of disposable razors with emollient dispensing devices will be able to make slight variations in the mechanical arrangement suggested hereby without departing from the spirit of the invention and still be within the scope of the claims appended hereto.

What is claimed is:

1. A disposable razor and emollient dispensing device comprising, in combination:

an elongate body, the outer portion of which forms a handle;

one or more blades attached at one end of said body;

reservoir means for supplying emollient to said razor; said reservoir means being within said elongate body;

an outflow orifice at one end of said reservoir;

razor mounting means for mounting to said elongate body each said blade with the face thereof lying in a plane normal to one containing the longitudinal axis of the elongate body, said razor mounting means having a passageway in cooperative functional relationship with said outflow orifice;

emollient distributor means for conducting emollient from the passageway of the razor mounting means to the edge of the blade; and, valve means for controlling the flow of emollient from the reservoir means, said valve means in turn comprising:

a valve body with a fluid conduit therethrough having a port and a seat; and a valve closure member movable away from and onto said seat for respectively opening and closing the conduit to fluid flow whereby emollient is delivered to the edge of the razor in a controlled manner.

2. A disposable razor and emollient dispensing device as described in claim 1 wherein said valve further includes a resilient return member for urging the valve closure member against said seat and thereby holding the valve in a normally closed position.

3. A disposable razor and emollient dispensing device as described in claim 2 wherein said valve closure member is a disk with one side thereof abutting said resilient return member.

4. A disposable razor and emollient dispensing device as described in claim 3 wherein said resilient return member is a spring.

5. A disposable razor and emollient dispensing devices as described in claim 4 wherein said spring is a coil spring.

6. A disposable razor and emollient dispensing device as described in claim 5 wherein said spring is a leaf spring.

7. A disposable razor and emollient dispensing device as described in claim 2 wherein said resilient return member is a compressible foam insert.

8. A disposable razor and emollient dispensing device as described in claim 1 wherein said reservoir means further includes a pressure inducing means for urging the emollient against the valve closure member.

9. A disposable razor and emollient dispensing device as described in claim 1 wherein said valve is a cylindrical valve.

10. A disposable razor and emollient dispensing device as described in claim 9 wherein said elongate body pivots throughout a predetermined angular range.

11. A disposable razor and emollient dispensing device as described in claim 10 wherein the pivoting action opens and closes said valve.

12. A disposable razor and emollient dispensing device as described in claim 11 wherein said device further comprises:

blade attaching means for attaching said one or more blades to said razor mounting means; and a protective cover demountably attaching to said razor mounting means with said one or more blades attached thereto by said blade attaching means.

13. A disposable razor and emollient dispensing device as described in claim 12 wherein said protective cover fixes the position of the pivotable said elongate body with the valve in the closed position.

14. A disposable razor and emollient dispensing device comprising, in combination:

an elongate body, the outer portion of which forms a handle;

at least one blade attached at one end of said body;

reservoir means for supplying emollient to said razor, said reservoir means being within said elongate body;

an outflow orifice at one end of said reservoir;

razor mounting means for mounting to said elongate body each said blade having a passageway in cooperative functional relationship with said outflow orifice, said razor mounting means and said elongate body pivotally attached the one to the other enabling the elongate body to pivot throughout a predetermined angular range;

emollient distributor means for conducting emollient from the passageway of the razor mounting means to the edge of the blade; and, valve means for controlling the flow of emollient from the reservoir means, said valve means in turn comprising:

a valve body formed from the pivot end portion of said elongate body with a fluid conduit therethrough having a port and a seat; and a valve closure member formed from the pivot end portion of said razor mounting means movable for respectively opening and closing the conduit to fluid flow;

whereby emollient is delivered to the edge of the razor in a controlled manner.

15. A disposable razor and emollient dispensing device as described in claim 14 wherein said reservoir means further includes a pressure inducing means for urging the emollient against the valve closure member.

* * * * *